US007862457B1

(12) United States Patent
Urcheck

(10) Patent No.: US 7,862,457 B1
(45) Date of Patent: Jan. 4, 2011

(54) ILLUMINATED ARROW

(76) Inventor: Travis Urcheck, 20007 Antago St., Livonia, MI (US) 48152

( * ) Notice: Subject to any disclaimer, the term of this patent is extended or adjusted under 35 U.S.C. 154(b) by 721 days.

(21) Appl. No.: 11/604,159

(22) Filed: Nov. 25, 2006

(51) Int. Cl.
*F42B 6/06* (2006.01)
*F42B 6/04* (2006.01)

(52) U.S. Cl. ..... 473/586; 473/570; 473/578

(58) Field of Classification Search ..... 473/570, 473/578, 585, 586
See application file for complete search history.

(56) References Cited

U.S. PATENT DOCUMENTS 4,615,552 A * 10/1986 Bengtson ..... 473/586
4,840,383 A * 6/1989 Lombardo ..... 473/585
4,989,881 A * 2/1991 Gamble ..... 473/570
5,024,448 A * 6/1991 Barrie ..... 473/586
5,134,552 A * 7/1992 Call et al. ..... 362/203
5,186,458 A * 2/1993 Redondo ..... 473/570
5,230,650 A * 7/1993 Brayton ..... 473/402
5,294,131 A * 3/1994 Manske ..... 473/571
5,425,542 A * 6/1995 Blackwood et al. ..... 473/570
6,428,432 B1 * 8/2002 Kachel ..... 473/570
6,533,688 B1 * 3/2003 Huang ..... 473/578

* cited by examiner

*Primary Examiner*—John Ricci

(57) ABSTRACT

An illuminated arrow is disclosed. An illustrative embodiment of the arrow includes an elongated arrow shaft, an arrow cavity provided in the arrow shaft, a plurality of fletchings each having a plurality of strands of fiber optic cable communicating with the arrow cavity and a light source communicating with the arrow cavity.

7 Claims, 2 Drawing Sheets

ILLUMINATED ARROW

FIELD

The present invention relates to archery arrows. More particularly, the present invention relates to an arrow having illuminated fletching which facilitates ease in finding the arrow after it is shot.

BACKGROUND

Many hunters prefer hunting using a bow and arrow over using a rifle. However, during bow hunting it is common for arrows to become lost when shot, particularly in a dark or heavily-wooded area. Therefore, an illuminated arrow is needed which facilitates ease in finding the arrow when shot from a bow.

SUMMARY

The present invention is generally directed to an illuminated arrow. An illustrative embodiment of the illuminated arrow includes an elongated arrow shaft, an arrow cavity provided in the arrow shaft, a plurality of fletchings each having a plurality of strands of fiber optic cable communicating with the arrow cavity and a light source communicating with the arrow cavity.

BRIEF DESCRIPTION OF THE DRAWINGS

The invention will now be described, by way of example, with reference to the accompanying drawings, in which.

DETAILED DESCRIPTION

Figure 1:
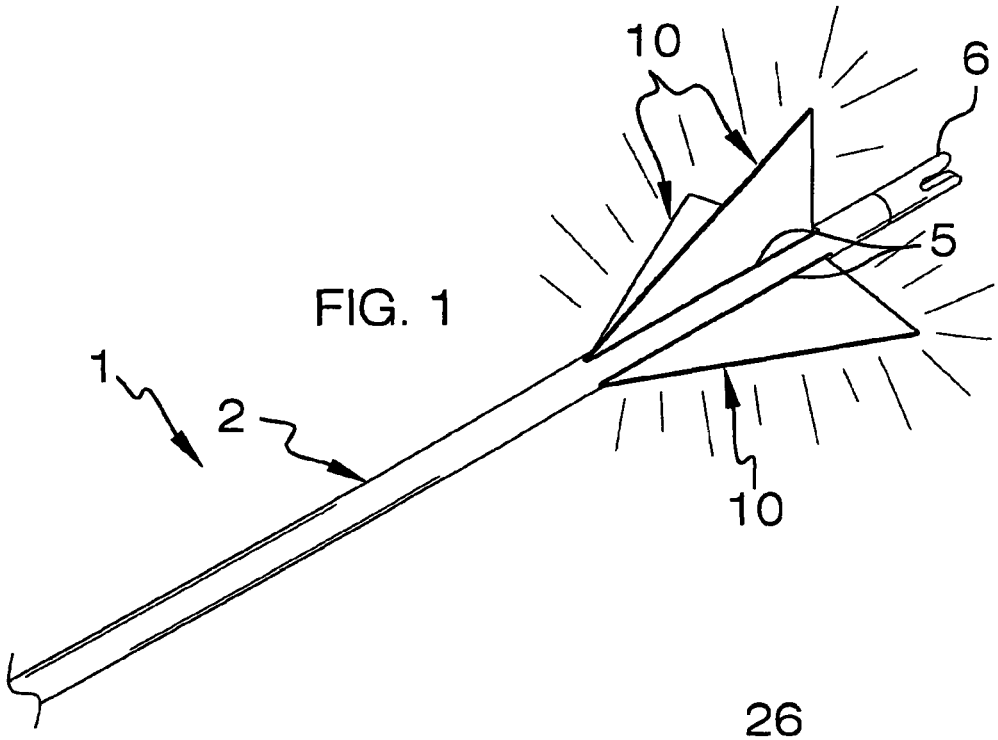
FIG. 1 is a perspective view, partially in section, of an illustrative embodiment of the illuminated arrow.
Figure 3:
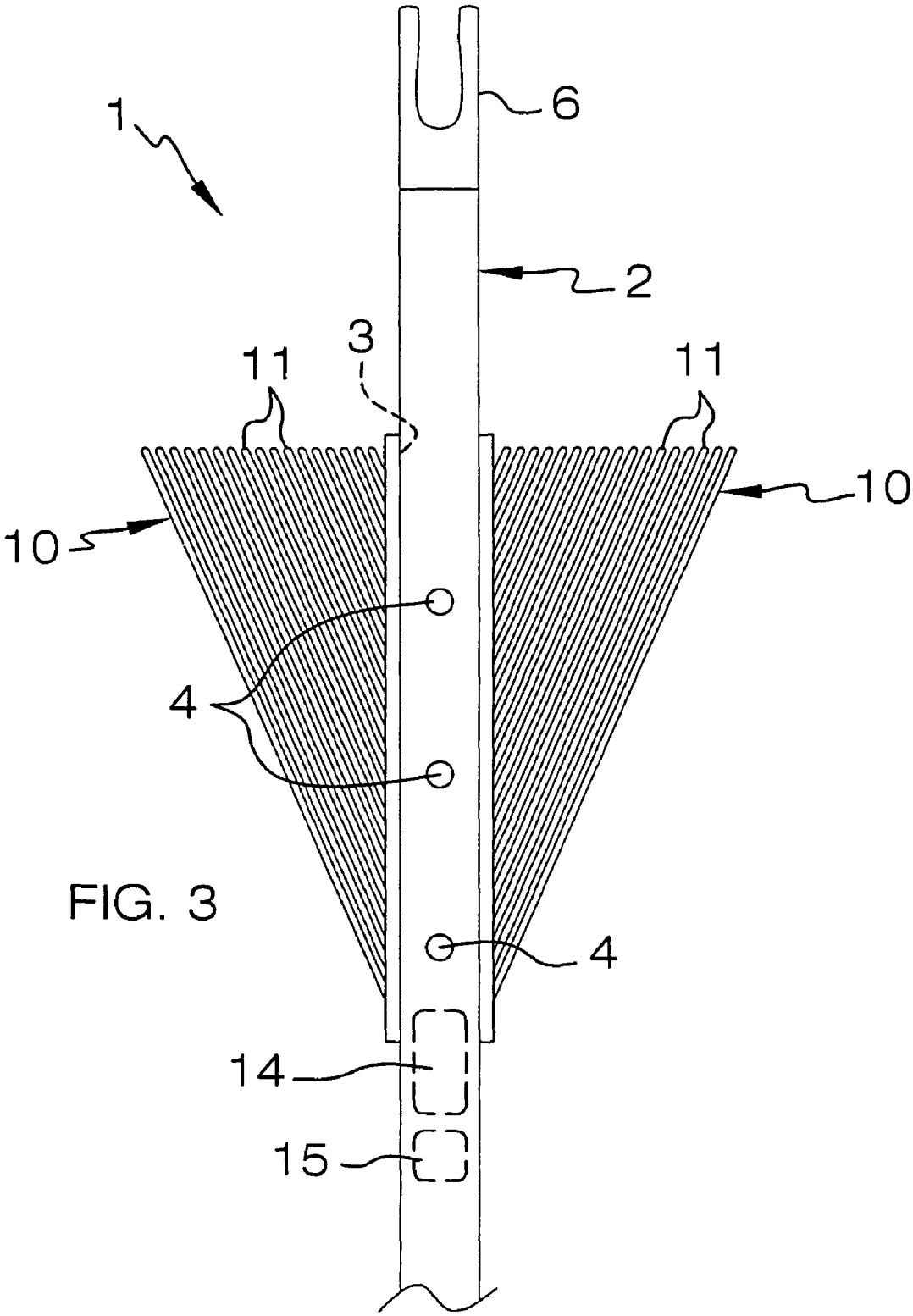
FIG. 3 is a top view of a rear portion of the illuminated arrow, more particularly illustrating a light source and an impact switch (shown in phantom) provided in an arrow shaft element of the arrow.

Referring to the drawings, an illustrative embodiment of the illuminated arrow (in section) is generally indicated by reference numeral 1 in FIGS. 1 and 3. The illuminated arrow 1 includes an elongated arrow shaft 2 having an arrow nock 6 on one end thereof. An arrow point (not shown) is provided on the opposite end of the arrow shaft 2. As shown in phantom in FIG. 3, an arrow cavity 3 is provided in the arrow shaft 2, generally adjacent or spaced-apart with respect to the arrow nock 6. Multiple light openings 4 extend through the wall of the arrow shaft 2 and communicate with the arrow cavity 3. In typical application, three rows of multiple, spaced-apart light openings 4 (one row of which light openings 4 is shown in FIG. 3) extend through the wall of the arrow shaft 2. The rows of light openings 4 are arranged in generally parallel, spaced-apart relationship with respect to each other around the circumference of the arrow shaft 2. Each light opening 4 communicates with the arrow cavity 3.

As shown in FIG. 1, multiple, elongated fletching slots 5 are provided in the arrow shaft 2. The fletching slots communicate with the respective rows of light openings 4. Each fletching slot 5 extends in generally parallel relationship with respect to the longitudinal axis of the arrow shaft 2.

A fletching 10 extends from each fletching slot 5. Each fletching 10 may be secured in each corresponding fletching slot 5 using glue and/or other technique known to those skilled in the art. Each fletching 10 includes multiple strands of fiber optic cable 11. The strands of fiber optic cable 11 of each fletching 10 are oriented in parallel, adjacent relationship with respect to each other and impart a generally triangular shape to each fletching 10. The fiber optic cable 11 of each fletching 10 communicates with the arrow cavity 3 through the light openings 4 in the corresponding row of light openings 4. As shown in FIG. 3, a light source 14, such as a light-emitting diode (LED), for example, is provided in the arrow shaft 2 and communicates with the arrow cavity 3. Upon activation, the light source 14 emits a beam of light (not shown) which travels through the arrow cavity 3, from which the light is emitted through the light openings 4 and strands of fiber optic cable 11 of each fletching 10, respectively. An impact switch 15 is connected to the light source 14 and facilitates activation of the light source 14 when the arrow 1 strikes a target (not shown). A time-delay circuit (not shown) may be provided in the impact switch 15 to facilitate illumination of the light source 14 for a predetermined period of time before inactivation. Alternatively, a switch button (not shown) may be provided on the impact switch 15 to facilitate manual inactivation of the impact switch 15.

Figure 2:
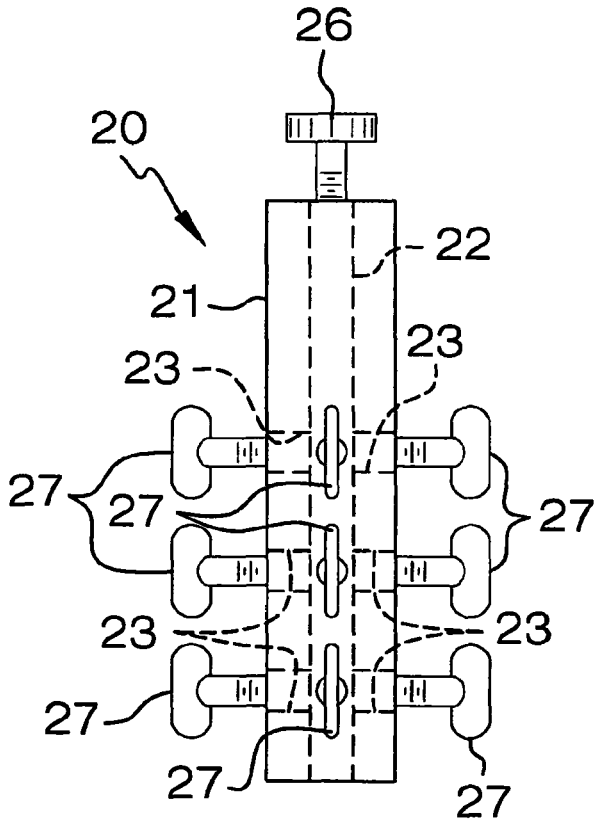
FIG. 2 is a side view of a tool which is suitable for rendering openings in the shaft of the illuminated arrow in fabrication of the arrow.

As shown in FIG. 2, a tool 20 which is suitable for making the arrow cavity 3 and light openings 4 in the arrow shaft 2 includes an elongated tool housing 21. A housing bore 22 traverses the tool housing 21. Multiple side screw openings extend transversely through the tool housing 21 and communicate with the housing bore 22. The side screw openings 23 are arranged in multiple rows which are provided around the circumference of the tool housing 21. An end screw 26 is threaded in the housing bore 22 at one end of the tool housing 21. Multiple side screws 27 are threaded into the respective side screw openings 23.

In use, the arrow shaft 2 is extended through the housing bore 22 of the tool housing 21. The side screws 27 are threaded into the respective side screw openings 23, and against and then into the arrow shaft 2 to form the respective light openings 4. The end screw 26 is threaded against and then into the end of the arrow shaft 2 to form the arrow cavity 3. The end screw 26 and side screws 27 are then unthreaded from the arrow cavity 3 and light openings 4, respectively, and the arrow shaft 2 is removed from the housing bore 22.

In typical use of the illuminated arrow 1, the impact switch 15 is initially set. The arrow 1 is then propelled by a stringed bow (not shown) toward a target (not shown). When the arrow 1 strikes the target or other object or surface, the impact switch 15 is illuminated, activating the light source 14. Consequently, the light source 14 emits a beam of light (not shown) into the arrow cavity 3 and through the light openings 4 and strands of fiber optic cable 11 of each fletching 10, respectively. Therefore, each fletching 10 is illuminated, enabling the shooter of the arrow 1 to find the arrow 1 in a dark or heavily-wooded area. The impact switch 15 is typically inactivated either manually or by a time-delay circuit (not shown).

While the preferred embodiments of the invention have been described above, it will be recognized and understood that various modifications can be made in the invention and the appended claims are intended to cover all such modifications which may fall within the spirit and scope of the invention.

What is claimed is:

1. An arrow, comprising:

an elongated arrow shaft;

an arrow cavity provided in said arrow shaft;

a plurality of fletchings each having a plurality of strands of fiber optic cable communicating with said arrow cavity;

a light source communicating with said arrow cavity;

an impact switch connected to said light source for activating said light source when said arrow strikes a target; and a plurality of rows of light openings provided in said arrow shaft and wherein said plurality of fletchings communicates with said plurality of rows of light openings, respectively.

2. The arrow of claim 1 further comprising a plurality of fletching slots provided in said arrow shaft and wherein said plurality of fletchings extends from said plurality of fletching slots, respectively.

3. The arrow of claim 1 further comprising a plurality of fletching slots provided in said arrow shaft and communicating with said plurality of rows of light openings, respectively, and wherein said plurality of fletchings extends from said plurality of fletching slots, respectively.

4. The arrow of claim 1 wherein said plurality of rows of light openings are arranged in generally parallel, spaced-apart relationship with respect to each other around a circumference of said arrow shaft.

5. The arrow of claim 1 wherein each of said plurality of fletchings has a generally triangular shape.

6. The arrow of claim 1 further comprising an arrow nock provided on said arrow shaft.

7. The arrow of claim 1 wherein said light source comprises a light-emitting diode.

* * * * *